US005428924A

United States Patent [19]

Pifer

[11] Patent Number: 5,428,924

[45] Date of Patent: Jul. 4, 1995

[54] HIGH SECURITY WINDOW/DOOR APPARATUS

[76] Inventor: George M. Pifer, 2424 Beach Ave., Apopka, Fla. 32703

[21] Appl. No.: 72,709

[22] Filed: Jun. 7, 1993

[51] Int. Cl.[6] ..... E06B 3/68; E06B 7/00

[52] U.S. Cl. ..... 49/50; 49/449; 52/656.8

[58] Field of Search ..... 49/61, 64, 50, 449; 52/204.1, 476, 656.7, 656.8

[56] References Cited

U.S. PATENT DOCUMENTS

| | | | |
|---|---|---|---|
| 1,791,680 | 2/1931 | Miller | 52/656.8 |
| 1,800,800 | 4/1931 | Kerby . | |
| 2,132,217 | 10/1938 | Neuendorf . | |
| 2,616,532 | 11/1952 | Bayley | 49/50 |
| 3,254,465 | 6/1966 | Brengman et al. . | |
| 3,305,623 | 2/1967 | Bakker et al. . | |
| 4,027,443 | 6/1977 | Briggs . | |
| 4,395,861 | 8/1983 | Fipke et al. | 52/106 |
| 4,485,589 | 12/1984 | Rodriguez-Torres | 49/50 |
| 4,649,681 | 3/1987 | Eisele . | |
| 4,967,509 | 11/1990 | Storey et al. | 49/64 |
| 5,226,919 | 7/1993 | Milligan | 52/656.8 |
| 5,251,417 | 10/1993 | Yates, Jr. | 52/656.8 |
| 5,319,879 | 6/1994 | Rozycki | 49/61 |

*Primary Examiner*—Michael J. Milano

[57] ABSTRACT

A high security window apparatus is disclosed which gives the appearance of a multi-pane window. Two transparent panes in parallel, spaced apart relationship are mounted to the inner periphery of a sash. A grid of high structural integrity metal bars is situated in the air region formed between the transparent panes, each bar having opposed ends which are securely mounted to the inner periphery of the sash by a reinforcing mounting arrangement. The grid pattern of the metal bars gives the appearance of a multi-pane window.

9 Claims, 3 Drawing Sheets

FIG. 2
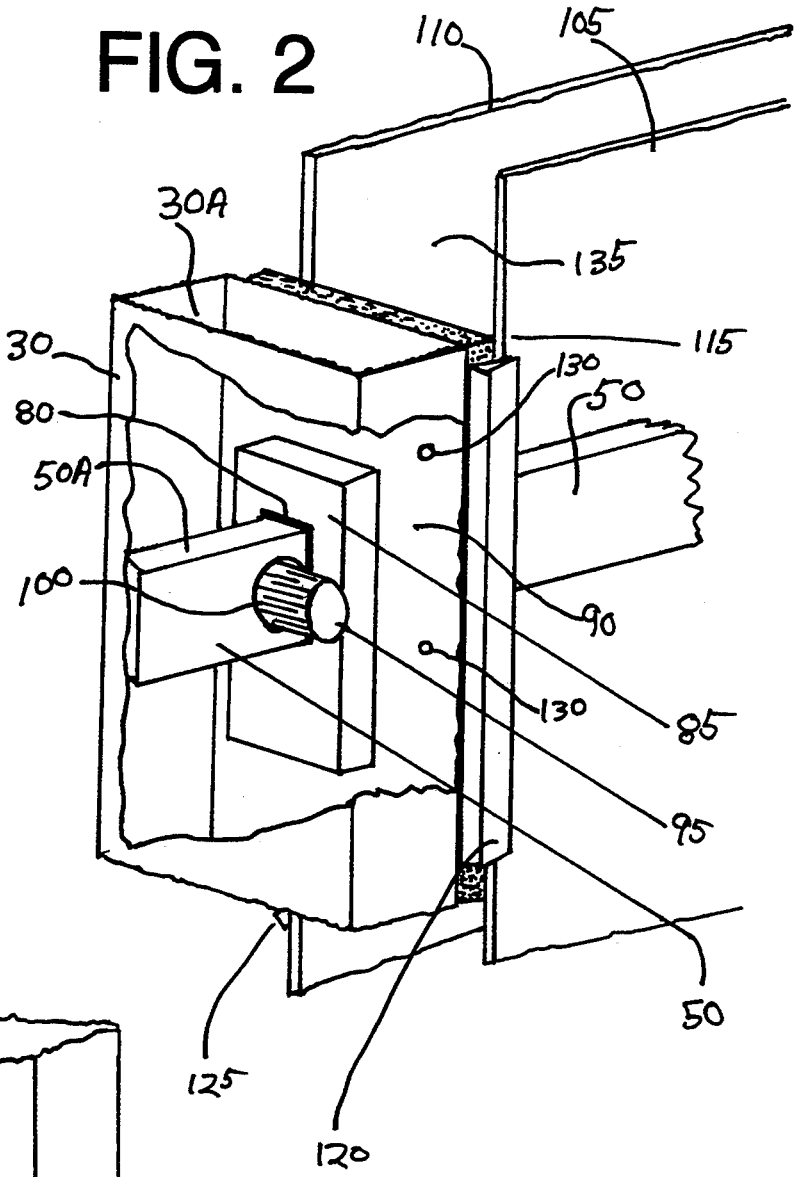
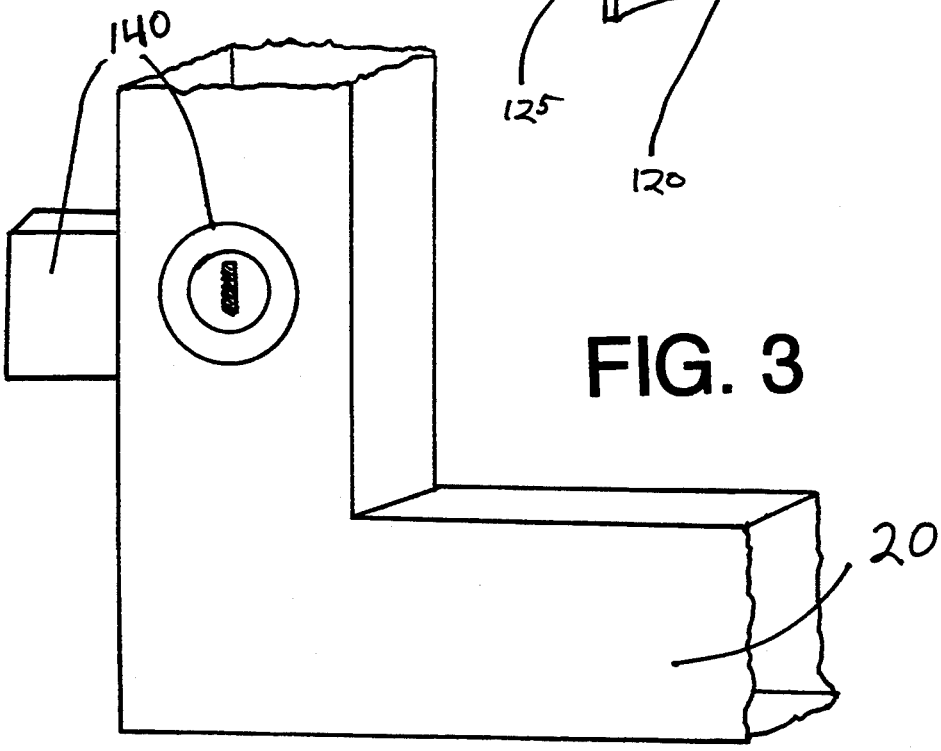
FIG. 3

HIGH SECURITY WINDOW/DOOR APPARATUS

BACKGROUND OF THE INVENTION

This invention relates in general to windows and doors and, more particularly, to security structures for windows and doors.

In the past, many security efforts with respect to windows and doors containing glass panes have been directed to equipping such windows and doors with stronger and more tamper-proof locks. Unfortunately, such efforts still leave the window or door vulnerable to entry through the glass which is mounted therein. Even with the best of locks, entry through the window may be only a simple matter of breaking the glass of the window and passing through the resultant opening.

Large panes of glass in a window are particularly subject to breakage and entry. It is known to place muntin structures over large glass panes to give the appearance of a plurality of smaller panes of glass in a window such as shown in U.S. Pat. No. 3,254,465 entitled "Divided Light Window" and issued to Brengman et al. Unfortunately, while giving the outward appearance of a multi-pane window, the muntin structure in such a divided light window is removable and decorative. For this reason, it fails to contribute to the structural integrity and security of the window.

Similarly, a patent to Neuendorf, U.S. Pat. No. 2,132,217, discloses a window including smooth glass panes between which a removable muntin bar assembly is situated to give the appearance of a multiple pane window. This window is also subject to unauthorized entry by breakage of the glass and removal of the muntin assembly.

Fire and impact resistant windows such as those disclosed in U.S. Pat. No. 4,027,443 issued to Briggs are also known. The Briggs window employs a three layer window with a first layer of deflectable, impact resistant polycarbonate material and second and third layers of fire glass of the embedded mesh type. While achieving a window structure of higher structural integrity than ordinary windows, this window structure is very expensive to manufacture. Moreover, this window is not commonly used in residential housing or businesses requiring a normal type and size of window.

It is also known to place a wire mesh layer between first and second transparent Plexiglas layers to form a "Shielded Window Construction" as disclosed in U.S. Pat. No. 4,305,623 issued to Bakker et al. While this window may achieve its goal of providing radio frequency shielding, it is not a high security structure.

In modern times with the increasing crime rate, secure windows and doors are more desirable than ever before. Many homeowners and business owners have resorted to placing iron bar structures or cages over existing windows. Most owners regard these bar structures as being very unsightly. However, these bar structures do a reasonably good job of foiling break-in attempts through the covered window. Nevertheless, the same bar structures and cages which deter unauthorized entry also unfortunately prevent the rightful occupant of the building from exiting through the window in an emergency. Many municipalities and regulatory authorities have recently passed ordinances, regulations or fire codes which require new windows to be of a type where the occupant can open the window and exit through the window in an emergency. Conventional bar structures for covering windows will not pass muster under these new regulations.

SUMMARY OF THE INVENTION

Accordingly, one object of the present invention is to provide a window structure of high structural integrity which is capable of vigorously resisting unauthorized entry.

Another object of the present invention is to provide a window structure which is aesthetically pleasing.

Still another object of the present invention is to provide a window which substantially maintains the appearance of a conventional multi-pane window.

Yet another object of the present invention is to provide a high security window which is capable of being opened from the inside by the authorized user in time of emergency.

In accordance with one embodiment of the present invention, a window apparatus is provided which includes a sash exhibiting a dosed geometry and having an inner periphery. The window apparatus also includes first and second transparent panes situated in parallel, spaced apart relationship and mounted to the sash at the inner periphery thereof. An air region is formed between the first and second panes. The window apparatus further includes a grid of high structural integrity metal bars situated in the air region between the first and second panes, each bar having opposed ends which are securely mounted to the inner periphery of the sash.

BRIEF DESCRIPTION OF THE DRAWINGS

The features of the invention believed to be novel are specifically set forth in the appended claims. However, the invention itself, both as to its structure and method of operation, may best be understood by referring to the following description and accompanying drawings.

FIG. 2 is a perspective view of the anchoring arrangement employed by the window of FIG. 1.

FIG. 3 is a perspective view of the locking arrangement employed by the window of FIG. 1.

DETAILED DESCRIPTION OF THE INVENTION

Figure 1:
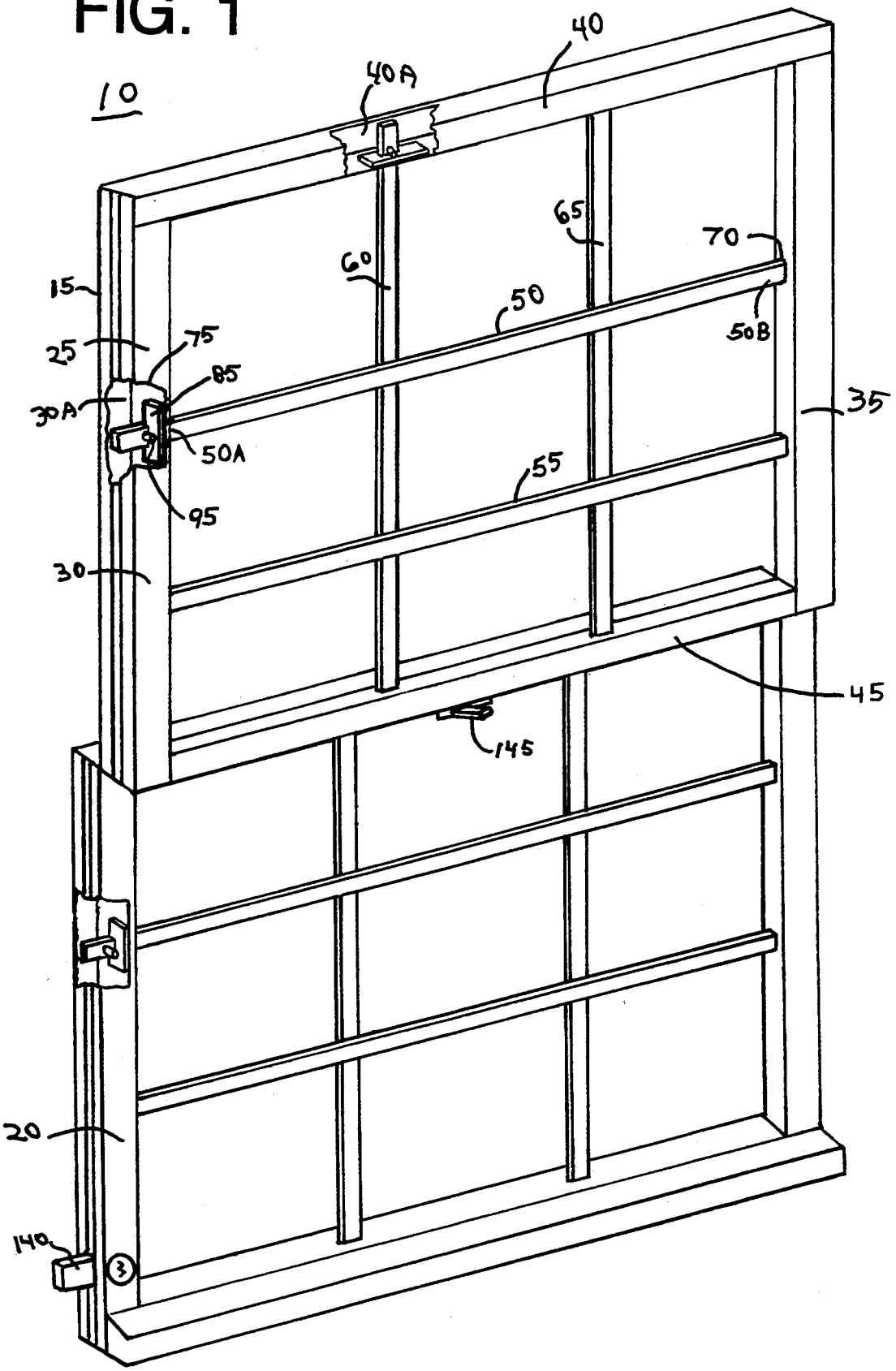
FIG. 1 is a perspective view of a window in accordance with the present invention.

FIG. 1 shows the window of the present invention in perspective as window assembly 10. In this particular embodiment, window assembly 10 includes an upper window 15 and a lower window 20 which are of substantially similar construction. Window 15 includes a substantially rectangular sash 25 which may be fixed or movable or within a frame (not shown). Sash 25 includes parallel, spaced apart, vertical sash members 30 and 35. Sash 25 further includes parallel, spaced apart, horizontal sash members 40 and 45. Sash members 30, 35, 40 and 45 are preferably fabricated from high strength aluminum. In the embodiment depicted in FIG. 1, sash members 30, 35, 40 and 45 each exhibit a substantially rectangular or square cross section and thus each sash member is tube-like in nature. In other words, sash member 30 includes an interior chamber which is visible in a cutaway section of FIG. 1 as interior chamber 30A. Similarly, sash member 40 includes an interior chamber which is visible in another cutaway section of FIG. 1 as interior chamber 40A. In a like manner, sash members 35 and 45 include interior chambers which are not visible in FIG. 1. All of these interior chambers meet and communicate air with one another.

Upper window 15 includes a plurality of horizontal, high strength bar members, for example horizontal bar members 50 and 55. Horizontal bar members 50 and 55 are in spaced apart relationship with respect to each other and horizontal sash members 40 and 45.

Upper window 15 also includes a plurality of vertical, high strength bar members, for example vertical bar members 60 and 65. Vertical bar members 60 and 65 are in spaced apart relationship with respect to each other and vertical sash members 30 and 35. Horizontal bar members 50 and 55 and vertical bar members 60 and 65 are fabricated from material which exhibits very high structural integrity and resistance to breakage. For example, metal materials such as Type 304 stainless steel, other steels and hard or hardened metals have been found to be satisfactory.

Bar members 50, 55,60 and 65 are mounted to the sash members with a highly breakage-resistant mounting arrangement now described in detail. Each of these bar members have opposed ends which are mounted to the corresponding sash members using substantially the same mounting arrangement. However, for example purposes, the mounting of bar 50 member will now be discussed. Bar 50 includes opposed ends 50A and 50B. Bar end 50A passes through an sash aperture (not visible in FIG. 1 ) in sash member 30. While this particular sash aperture is not visible in FIG. 1, the corresponding sash aperture 70, through which remaining bar end 50B passes through sash member 35 is visible in FIG. 1. To more clearly illustrate how bar end 50A is mounted within sash member 30, a cutaway portion 75 of sash member 30 is taken and shown in close-up perspective view in FIG. 2.

The tubular nature and rectangular cross-sectional geometry of sash member 30 can be readily appreciated in FIG. 2 which illustrates the mounting arrangement of bar end 50A to sash member 30. A portion of the aforementioned interior chamber 30A or interior cavity is clearly seen in this view. After bar end 50A passes through the above-discussed sash aperture (not shown) in sash member 30, bar end 50A passes through a reinforcement piece aperture 80 in reinforcement piece 85 which is mounted to the interior wall 90 of sash member 30. Reinforcement piece 80 is a rectangular block, preferably fabricated from a metallic material. An anchor peg 95 is press fit or snugly fit into a hole 100 located in bar end 50A such that anchor peg 95 fits flushly against reinforcement piece 85 and such that reinforcement piece 85 is held against interior wall 90. Additional adhesive may be employed to further affix anchor peg 95 to hole 100. Adhesive may also be applied between reinforcement piece 85 and interior wall 90 to assure that reinforcement piece 85 does not rattle while in position.

The same mounting arrangement described here with respect to bar end 50A is employed at remaining bar end 50B. The flush fit of anchor 95 against reinforcement piece 85 at both ends 50A and 50B of bar 50 prevents lateral movement of bar 50 should a break-in be attempted. This contributes significantly to the structural integrity of the window apparatus of the present invention.

As seen in FIG. 2, the bar structure formed by bar members 50, 55,60 and 65 is situated between 2 parallel panes 105 and 110 of glass or other transparent material. For clarity, these two panes of glass were not shown in FIG. 1 since the bar structure which is an important part of the present invention would have then been obscured.

Inner pane 105 and outer pane 110 are held to the inner exterior walls of sash members 30, 35, 40 and 45 of sash 25 by a layer of sealant adhesive 115 shown between sash member 30 and panes 105 and 110 in FIG. 2. Beading strips 120 and 125 are situated around the entire peripheral edge of panes 105 and 110, respectively, to hold these panes in place within the sash members and to provide additional sealing.

A desiccant material is situated within the interior cavities of sash members 30, 35, 40 and 45 to absorb moisture therein. The interior wall 90 of sash member 30 includes one or more weep holes 130 which permit the air in chamber 30A to communicate with the air in the inter-window space 135 formed between window panes 105 and 110. In this manner, potential condensation which might tend to appear in inter-window space 135 is absorbed by the desiccant within chamber 30A. Sash members 35, 40 and 45 may include similar weep holes to further lessen the likelihood of condensation problems. It is noted that inter-window space 135 provides energy efficient insulation to the window structure of the invention.

Window 15 may be of the fixed variety or the hung variety. As shown in FIG. 1, a lower window 20 which is substantially similar to window 15 may be hung together with window 15 in a double-hung arrangement. Whatever the particular hanging arrangement for the window, standard window mounting techniques may be employed. More particularly, upper window 15 and lower window 20 are easily and advantageously mounted in a conventional window frame (not shown) in the standard manner.

As seen in FIG. 1, one embodiment of window 20 provides for a dead-bolt type lock 140 which is shown in more detail in the close-up view of FIG. 3. In the double hung window arrangement depicted in FIG. 1, upper window 15 and lower window 20 may be equipped with a standard latch mechanism to hold the windows in the position depicted in FIG. 1. For example, the underside of lower sash member 45 of upper window 15 can be equipped with a standard latch 145 and the upper sash member of lower window 20 can be equipped with a mating standard latch receiving mechanism (not shown) commonly employed on double hung windows.

Figure 4:
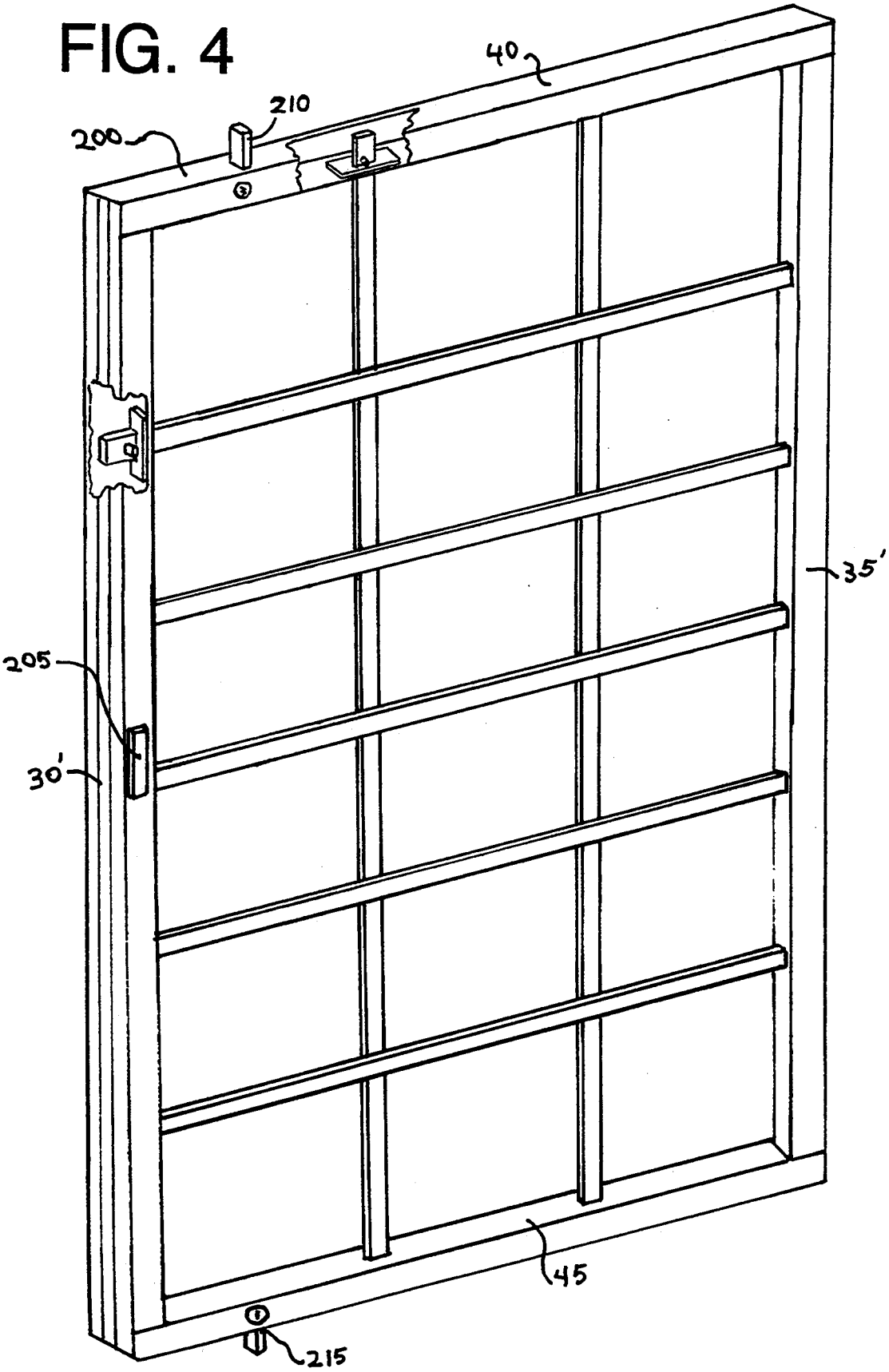
FIG. 4 is a perspective view of a door in accordance with the present invention.

It will be appreciated that the above disclosed window structure of the invention is readily adaptable to doors as well. The window structure of the invention may be employed in hinged doors, sliding doors, vertically raised doors or other doors which include window structures. For example, FIG. 4 shows one such door which includes a window structure in accordance with the present invention as door 200. Door 200 is substantially similar to window 15 of FIG. 1 with like numbers indicating like elements.

One difference between door 200 of PIG. 4 and window 15 of FIG. 1 is that vertical sash members 30 and 35 have been vertically extended to be an appropriate height for a door and are now designated as sash members 30′ and 35′. The vertical and horizontal bar members in door 200 of FIG. 4 are anchored to the sash members of the door using the same mounting arrangement already described above in detail with respect to bar members 50, 55, 60 and 65 of FIG. 1.

Door 200 may be equipped with standard door knobs, handles and locks as desired. For example, door 200 is equipped with a handle 205 and vertical deadbolt locks 210 and 215 which engage the surrounding door frame (not shown). Deadbolt locks 210 and 215 are recessed within door 200 when unlocked. Other conventional locking arrangements may be used as well. Depending on whether a swinging, sliding or vertically raising door is desired, door 200 can be equipped with the appropriate standard hinges, slider structure or vertical raising mechanism. Such equipment is regarded as standard and is therefore not shown in detail in FIG. 4.

The foregoing has described a window apparatus which is capable of vigorously resisting unauthorized entry. Advantageously, the window structure is aesthetically pleasing and substantially maintains the appearance of a conventional multi-pane window. The disclosed high security window apparatus is desirably capable of being opened from the inside by the authorized user in time of emergency.

While only certain preferred features of the invention have been shown by way of illustration, many modifications and changes will occur to those skilled in the art. For example, whereas the bar structure shown includes horizontal and vertical bars which form a repeating rectangular pattern, the bars could also be readily arranged to form other patterns such as diamond-shaped. It is, therefore, to be understood that the present claims are intended to cover all such modifications and changes which fall within the true spirit of the invention.

What is claimed is:

1. A window apparatus comprising:

a sash exhibiting a closed geometry and having an inner periphery;

first and second transparent panes situated in parallel, spaced apart relationship and mounted to said sash at the inner periphery thereof, an air region being formed between said first and second panes;

a grid of high structural integrity metal bars situated in the air region between said first and second panes, each bar having opposed ends which are securely mounted to the inner periphery of said sash;

said sash comprising a tube of metallic material having an inner peripheral surface including a plurality of sash apertures through which respective ends of said metal bars pass, said tube including an interior cavity in which said respective ends of said metal bars are situated; and a reinforcement member situated within said interior cavity of said tube at each sash aperture, each reinforcement member including a reinforcement member aperture for permitting an end of said metal bar to pass therethrough.

2. The window apparatus of claim 1 wherein each end of each bar includes a bar aperture at a location on said bar within said interior cavity of said tube.

3. The window apparatus of claim 2 further comprising a plurality of anchor pegs respectively situated in said bar apertures to hold the ends of said metal bars to said reinforcement member and said sash.

4. The window apparatus of claim 1 wherein said grid is comprised of steel.

5. The window apparatus of claim 1 wherein said grid is comprised of hardened steel.

6. The window apparatus of claim 1 wherein said grid is comprised of stainless steel.

7. The window apparatus of claim 1 wherein said tube exhibits a substantially rectangular cross section.

8. The window apparatus of claim 1 wherein said window apparatus is dimensioned to form a door.

9. The window apparatus of claim 1 wherein the bars in said grid include a plurality of spaced apart vertical bars and a plurality of spaced apart horizontal bars which give each of the first and second transparent panes the appearance of being formed of multiple panes of glass.

* * * * *